US006467126B1

(12) United States Patent
Yezersky et al.

(10) Patent No.: US 6,467,126 B1
(45) Date of Patent: Oct. 22, 2002

(54) DOOR CHECK MECHANISM PROVIDING AN INFINITE NUMBER OF STABLE POSITIONS

(75) Inventors: Grigory Yezersky, Farmington Hills, MI (US); Gerald Cilibraise, Livonia, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 193 days.

(21) Appl. No.: 09/620,257

(22) Filed: Jul. 21, 2000

(51) Int. Cl.[7] ..... E05C 5/06
(52) U.S. Cl. ..... 16/86 C; 16/86 B
(58) Field of Search ..... 16/86 C, 86 B, 16/85

(56) References Cited

U.S. PATENT DOCUMENTS

| | | | | |
|---|---|---|---|---|
| 2,032,600 | A | | 3/1936 | Smith |
| 2,237,046 | A | | 4/1941 | Breitenwischer |
| 2,290,331 | A | | 7/1942 | Jacobs |
| 2,321,409 | A | | 6/1943 | Moore |
| 2,693,616 | A | | 11/1954 | Cormwell et al. |
| 2,724,143 | A | | 11/1955 | Galla |
| 2,787,019 | A | | 4/1957 | Galla |
| 2,860,369 | A | | 11/1958 | Galla |
| 2,980,945 | A | | 4/1961 | Hollar, Jr. |
| 3,012,269 | A | | 12/1961 | Bartel |
| 3,051,983 | A | | 9/1962 | Dale |
| 3,369,833 | A | | 2/1968 | Schaldenbrand |
| 3,643,289 | A | * | 2/1972 | Lohr |
| 3,979,790 | A | | 9/1976 | Chiarappa |
| 3,980,331 | A | | 9/1976 | Kennedy et al. |
| 4,048,695 | A | | 9/1977 | Juilfs et al. |
| 4,194,264 | A | | 3/1980 | Stoffregen |
| 4,658,468 | A | | 4/1987 | Tillmann et al. |
| 4,663,801 | A | | 5/1987 | Malopolski, Jr. |
| 4,670,941 | A | * | 6/1987 | Peterson |
| 4,672,715 | A | * | 6/1987 | Beckwith |
| 4,785,493 | A | | 11/1988 | Tillmann et al. |
| 4,788,743 | A | | 12/1988 | Okumura |
| 4,833,755 | A | | 5/1989 | Bonin |
| 4,841,600 | A | | 6/1989 | Sasamura et al. |
| 4,912,806 | A | | 4/1990 | Orii et al. |
| 5,074,010 | A | | 12/1991 | Gignac et al. |
| 5,152,030 | A | | 10/1992 | Cogo |
| 5,173,991 | A | | 12/1992 | Carswell |
| 5,474,344 | A | | 12/1995 | Lee |
| 5,509,175 | A | * | 4/1996 | Baughan et al. |
| 5,727,287 | A | | 3/1998 | Hosken et al. |
| 5,862,570 | A | | 1/1999 | Lezuch et al. |
| 6,065,185 | A | | 5/2000 | Breed et al. |

* cited by examiner

*Primary Examiner*—Anthony Knight
*Assistant Examiner*—Mark Williams
(74) *Attorney, Agent, or Firm*—Mark P. Calcaterra

(57) ABSTRACT

A vehicle door check assembly is provided including a roller in rolling engagement with an arm. The roller cooperatively engages the arm such that an elastically deformable material is encountered at the roller arm interface providing the vehicle door with an infinite number of secure resting positions between fully closed and fully open conditions.

26 Claims, 4 Drawing Sheets

DOOR CHECK MECHANISM PROVIDING AN INFINITE NUMBER OF STABLE POSITIONS

FIELD OF THE INVENTION

The present invention relates generally to articulating doors for motor vehicles, and more particularly to a checkstrap assembly operative to positively locate a passenger door in an infinite number of positions between a fully open position and a closed position.

BACKGROUND OF THE INVENTION

In a conventional manner, passenger doors of motor vehicles are pivotally mounted to the vehicle body for movement between a fully open position and a closed position. Many such vehicle doors are designed to cooperate with a checkstrap which is operative for positively locating the door relative to the vehicle body. Additionally, on sloped surfaces, the checkstrap provides a mechanism to hold the door in its open position. Typically, a vehicle door will have an intermediate point between fully open and fully closed where the door will rest in a stable fashion. In situations where a space laterally adjacent to a passenger door prohibits the door from fully opening, opening of the door to the intermediate position may reduce incidents of unintentional damage.

In one common form, prior checkstraps for vehicle doors include a roller mounted to the vehicle body and an arm contoured to cooperate with the roller which is carried by the vehicle door. In this regard, the arm is formed to include one or more camming surfaces. The roller functions as the cam follower. As the door is moved between its fully opened position and its closed position, the arm remains in constant engagement with the roller. When the door is gently opened or closed, the cam surfaces of the arm and the roller cooperatively function to positively define an intermediate position at which the door may be located relative to the vehicle body.

While known arrangements are commercially acceptable, they are also limited with specific disadvantages and thereby subject to improvement. In this regard, the common roller camming arm configuration provides one set intermediate position which the door can securely rest. Usually the camming surface encourages the door to rest in one of the defined locations. This situation often requires the operator to hold the door when the defined locations are not acceptable. Often the intermediate position may not be in an optimal location for a given situation. It may be desired to open the door securely in a position greater or less than the set intermediate point and leave it thereby unassisted.

SUMMARY OF THE INVENTION

It is an object of the present invention to provide a door check assembly for a passenger door of a motor vehicle having an infinite amount of secure door locations between the fully closed and fully open position.

It is still another object of this invention to provide a door check assembly for a passenger door of a motor vehicle having a minimal amount of resistance.

In order to obtain these and other objects, a first embodiment of the present invention provides a door checkstrap assembly for a door of a vehicle which is movable in relation to a frame between a closed position and an open position. The checkstrap assembly includes an arm passing through an aperture in the closure member. The arm has a first end interconnected to the frame and a second end retained within the door such that the door may be selectively moved relative to the arm. The cam arm and roller configuration cooperate such that an elastically deformable material is encountered at the interface point.

According to yet another embodiment of the present invention, the check assembly includes a hinge connecting the door to the frame of the vehicle. The hinge includes a roller biased against a uniform camming surface. The hinge is configured such that an elastically deformable material is encountered at the interface point.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
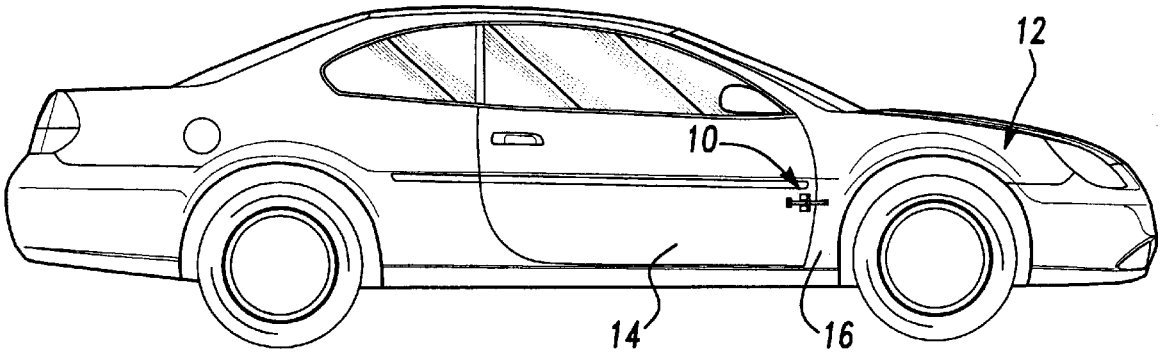
FIG. 1 is an environmental view of a checkstrap assembly constructed in accordance with the teachings of the preferred embodiment of the present invention and shown operatively installed within a vehicle so as to interconnect a passenger door with the body of the vehicle.

The present invention provides an improved checkstrap assembly specifically intended for use with a passenger door of a motor vehicle. With reference to the drawings, a checkstrap assembly constructed in accordance to the teachings of the present invention is illustrated and identified with reference numeral 10 as shown in FIG. 1. The checkstrap assembly is installed on an otherwise conventional vehicle 12 and functions to operatively interconnect a passenger door 14 of the vehicle 12 with the body 16 of the vehicle 12. The intended purpose of the checkstrap assembly 10 to positively locate the door 14 in an infinite number of secure positions between a fully open and fully closed position will become apparent below.

Figure 2:
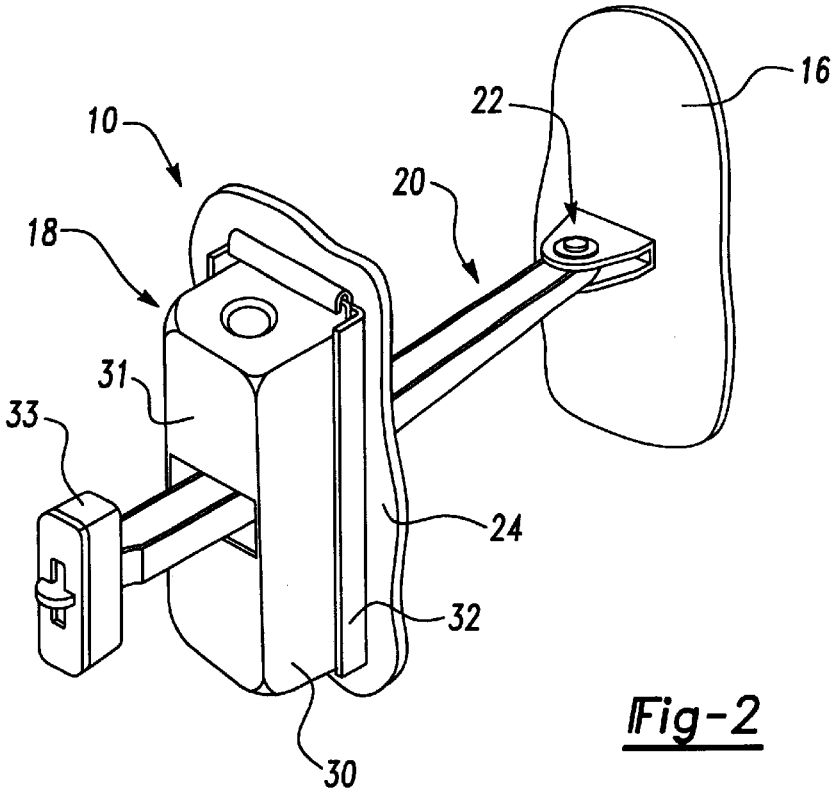
FIG. 2 is an enlarged perspective view of the checkstrap assembly of FIG. 1 removed from the vehicle for purposes of illustration.
Figure 3:
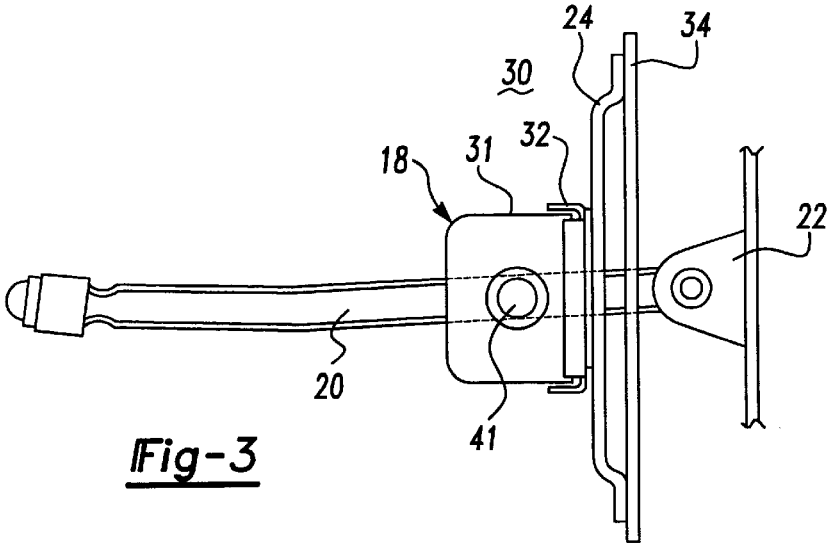
FIG. 3 is a top view of the checkstrap assembly of FIG. 2, illustrating the checkstrap assembly as the vehicle door is in a closed position relative to the vehicle body.
Figure 4:
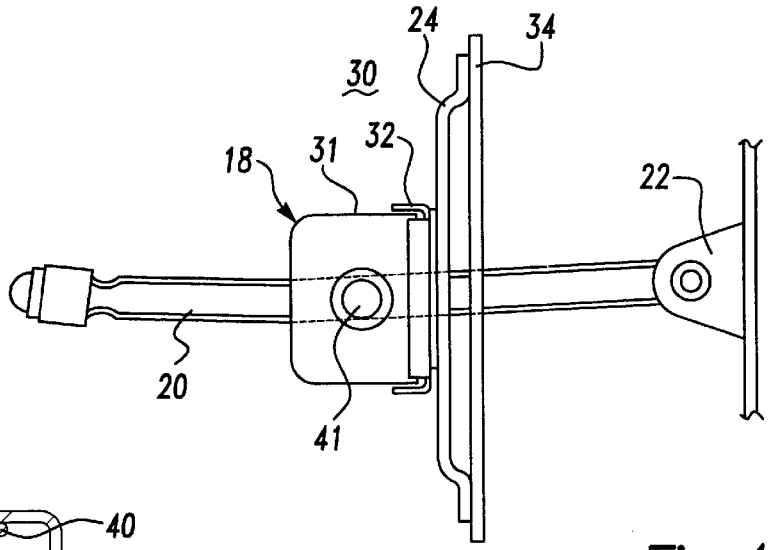
FIG. 4 is a top view of the checkstrap assembly similar to FIG. 3, illustrating the checkstrap assembly as the vehicle door is in an intermediate position relative to the vehicle body.
Figure 5:
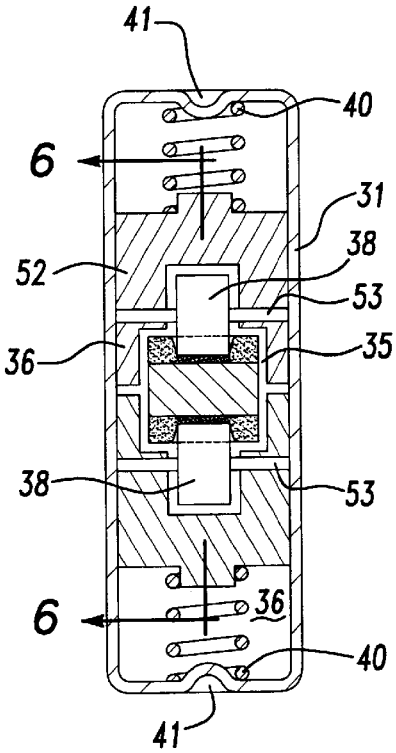
FIG. 5 is a cross sectional view of the roller housing of FIG. 2.

With reference now to FIGS. 2–4, the checkstrap assembly 10 of the present invention is shown to generally include a locating mechanism 18, a cooperating arm or strap 20 and a mounting bracket 22. The locating mechanism 18 is suitably fastened to an adapter plate 24 which is in turn welded or otherwise suitably fastened to an inner side of the forward panel 34 of passenger door 14. While not specifically shown, it will be understood that the adapter plate 24 may be attached to a forward panel 34 of passenger door 14 by welding or any other suitable manner well known in the art. As a result, the locating mechanism 18 and the adapter plate 24 are disposed within an interior chamber 30 of the passenger door 14 which is defined in part by the forward panel 34 of the door 14 (best shown in FIGS. 3 and 4).

Prior to describing the specific operation and function of the locating mechanism 18 of the preferred embodiment of the present invention an understanding of the remaining components of the checkstrap assembly 10, which would be understood to be largely exemplary in nature, is warranted.

The arm 20 is pivotally mounted at one end to the mounting bracket 22. The mounting bracket is adapted to be mounted to the frame or body 16 of the vehicle 12. A stop member 33 is mounted to a second end of the arm 20.

As shown in FIGS. 2–5, the locating mechanism 18 of the checkstrap assembly 10 includes a housing 31 and a cover 32 which are crimped together and define an internal cavity 36. A channel 35 passes through the locating mechanism 18 through which the arm 20 passes. Disposed within the internal cavity 36 of the locating mechanism 18 are a pair of rollers 38 which are rotatably supported by a cooperating pair of roller cases 52 by an axle 53. The roller cases 52 are biased toward one another by a pair of springs 40. The springs 40 are seated against detents 41 formed in the housing 31. The rollers 38 are located on opposite sides of the arm 20 and are biased into engagement with the arm 20 by springs 40. Alternatively, the rollers 38 and the arm 20 may be constructed of magnetic materials such that a magnetic force biases the rollers 38 to the arm 20.

Figure 6:
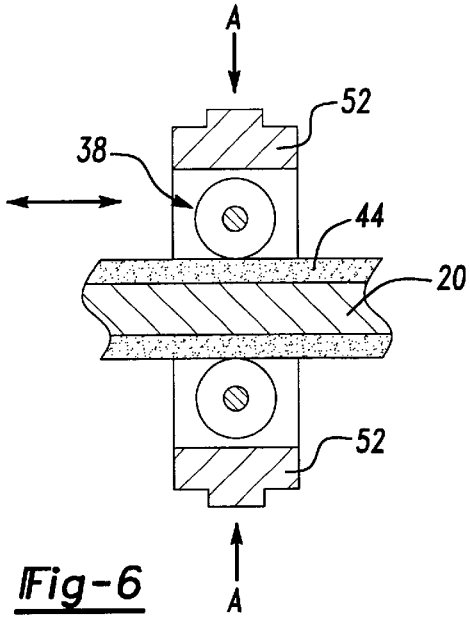
FIG. 6 is a cross sectional view of the roller housing taken along line 6—6 of FIG. 5 shown with the arm in motion and elastically deformable material disposed on the arm.
Figure 7:
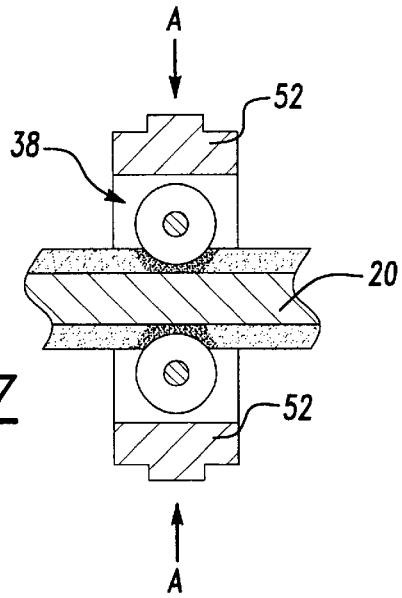
FIG. 7 is a cross sectional view similar to FIG. 6 shown with the arm in a static state and the elastically deformable material being deformed.
Figure 7A:
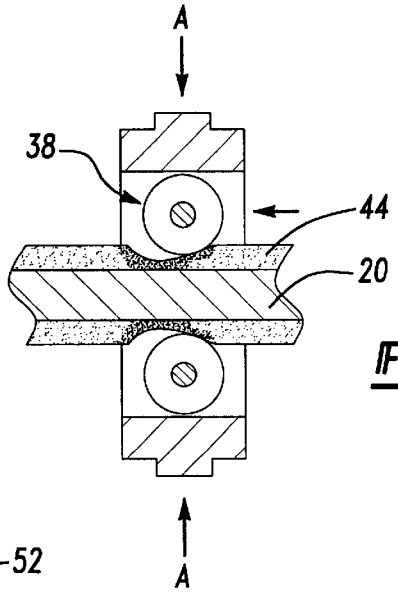
FIG. 7*a* is a cross sectional view similar to FIG. 6 shown immediately after initial movement of the arm.

As will become apparent below, the locating mechanism 18 is positively located relative to the arm 20, and in turn, the passenger door 14 is positively located relative to the body 16 of the vehicle 12 through engagement of the rollers 38 onto the cooperating arm 20. As shown in FIGS. 6 and 7, a layer of elastically deformable material 44 such as foam, rubber or any suitable material capable of changing shape after exertion of a load is disposed on the surface of the cooperating arm 20 by adhesive or other conventional means. FIG. 6 depicts the elastically deformable material 44 disposed on the cooperating arm 20 engaged by the rollers 38 in a dynamic state as the door 14 is moved between a closed position and a fully open position. The illustrated dynamic condition in FIG. 6 exists when a force exerted on arm 20 overcomes the Force A supplied by the springs 40. FIG. 7 depicts the elastically deformable material 44 disposed on the cooperating arm 20 engaging the rollers 38 in a static state. The rollers 38 are recessed securely into the deformed elastically deformable material 44 due to the Force A exerted from the springs 40. In order to move the door 14 when the rollers 38 are recessed securely into the deformed elastically deformable material 44, a checking force is necessary to overcome the Force A. FIG. 7*a* illustrates the elastically deformable material 44 immediately after initial movement of the arm 20. A preliminary indentation is shown in the elastically deformable material 44 behind the rollers 38 which retracts to its original condition as the arm proceeds to translate. When the arm 20 is in motion, the rollers 38 roll across the surface of the elastically deformable material 44 and the surface of the elastically deformable material 44 does not have time to deform. When the speed of arm 20 falls below a predetermined amount (dependent on the load force and the characteristics of the deformable material), the elastically deformable material 44 deforms to allow the roller 38 to recess therein to create a secure position of the arm 20 relative to the locating mechanism 18.

Figure 8:
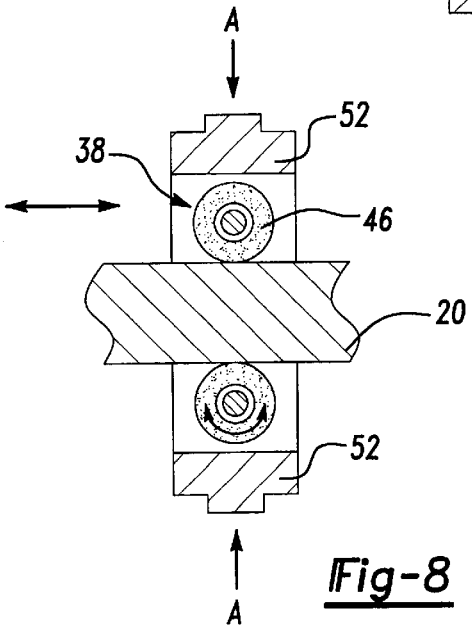
FIG. 8 is a cross sectional view similar to FIG. 6 shown with the elastically deformable material disposed on the roller and with the arm in motion.
Figure 9:
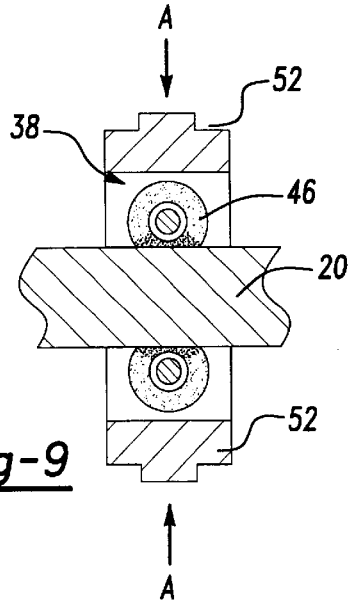
FIG. 9 is a cross sectional view similar to FIG. 8 shown with the elastically deformable material disposed on the roller and with the arm in a static state.

FIGS. 8 and 9 depict a variation in that the elastically deformable material 46 is disposed on the rollers 38. The illustrated dynamic condition in FIG. 8 exists when a force exerted on arm 20 is greater than the Force A supplied by the springs 40. FIG. 8 shows the cooperating arm 20 engaging the elastically deformable material 46 disposed on the rollers 38 in a dynamic state as the door 14 is moved between a closed position and a fully open position. FIG. 9 shows the elastically deformable material 46 disposed on the rollers 38 in a static state. The surface of the rollers 38 are flattened at the interface with the arm 20 and inhibit relative movement of the arm 20 relative to the rollers 38.

Figure 10:
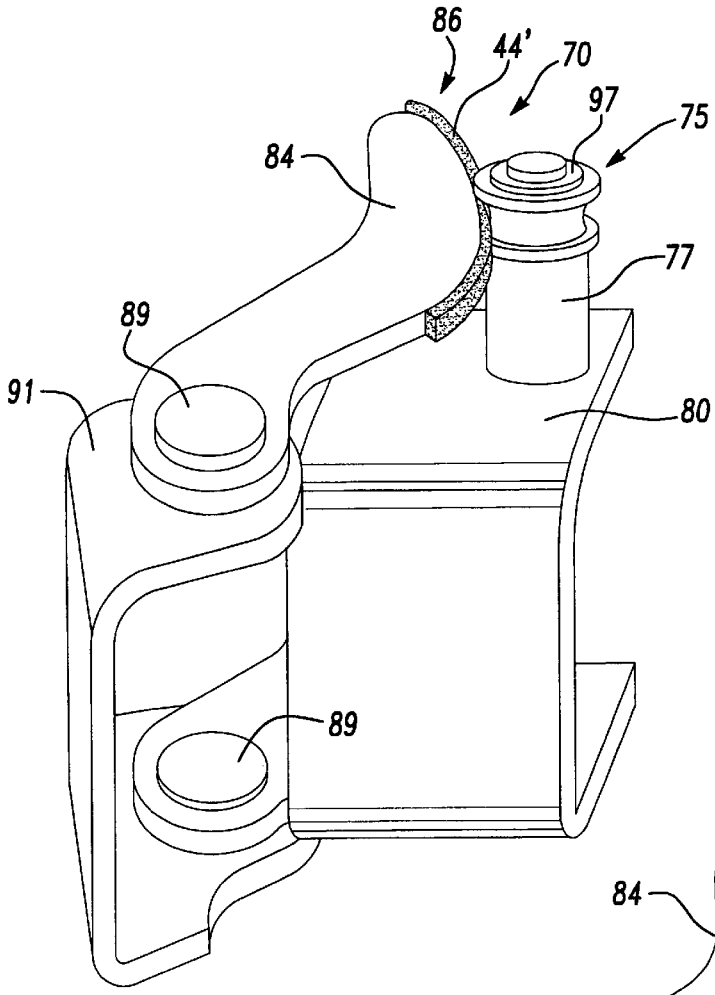
FIG. 10 is a perspective view of a second embodiment of the present invention.

Turning now to FIG. 10, the door check mechanism according to the second embodiment of the present invention includes a hinge and roller configuration 70 at the vehicle frame, door interface. The roller 75 is rotatably mounted and secured with a lock washer 97 or other suitable fastener to the end of shaft 77 and connected to a bracket 80 which is welded or suitably affixed to the door 14 and is configured to follow the camming arm 84 included in the frame of vehicle 12. The cam arm 84 is pivotally attached by rivets 89 to a mounting bracket 91 that is welded or suitably affixed to vehicle 12. The roller 75 and camming surface 86 are biased magnetically or by a spring force (not specifically shown). The camming surface 86 includes an elastically deformable material 44'. When the arm 20 is in motion, the roller 75 rolls across the surface of the elastically deformable material 44' and the surface of the elastically deformable material 44' does not have time to deform. When the speed of arm 20 falls below a predetermined amount (dependent on the load force and the characteristics of the deformable material), the elastically deformable material 44' deforms to allow the roller 75 to recess therein to create a secure position. When the arm 20 stops moving, the elastically deformable material 44' deforms to allow the roller 75 to recess therein to create a secure resting position.

Figure 11:
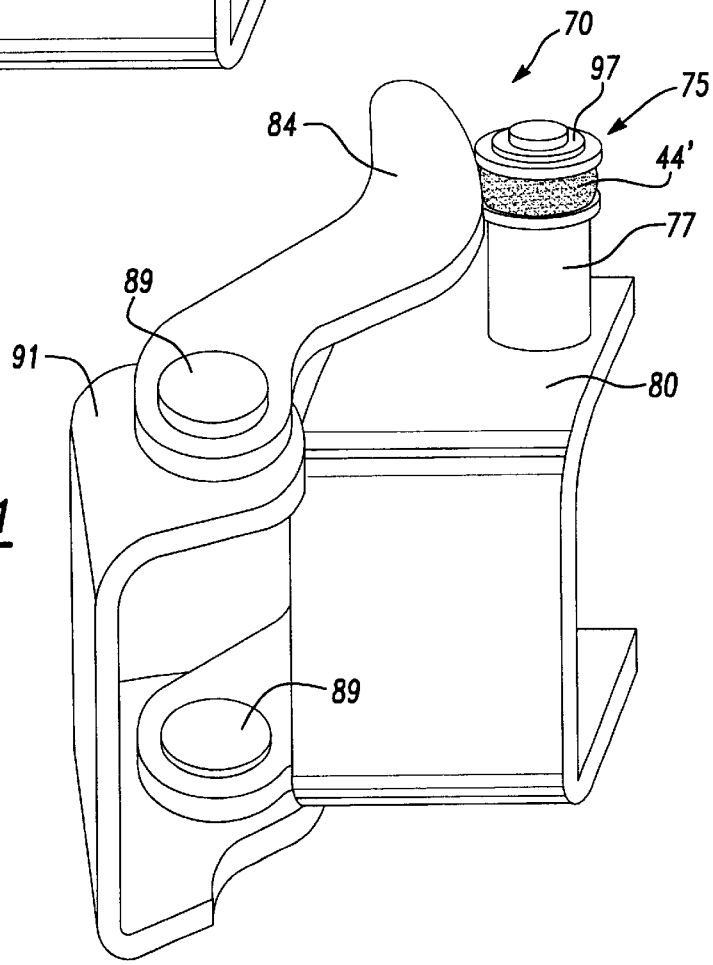
FIG. 11 is a perspective view of an alternate configuration of the second embodiment of the present invention.

FIG. 11 is an alternative configuration of the second embodiment wherein the elastically deformable material 44' is disposed on the roller 75. When the arm 20 is in motion, the roller rolls across the surface of the elastically deformable material 44' and the elastically deformable material 44' does not have time to deform. When the arm 20 stops moving, the elastically deformable material 44' on the roller 75 compresses allowing the camming surface 86 to seat into the roller 75 to create a secure position of the arm 20 relative to the locating mechanism 18.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle door check assembly for use with a door of a vehicle for holding the door in an infinite number of stable positions relative to a door frame, comprising;

a first member adapted to be connected to one of the door and the door frame;

a second member supported in rolling engagement with said first member; and a surface disposed on one of said first member and said second member capable of being elastically deformed at an engagement interface between the first and second members to an extent sufficient to hold the first and second members in a stable stopped position whenever the rolling engagement drops below a predetermined speed.

2. The check assembly according to claim 1, wherein said surface is disposed on said first member.

3. The check assembly according to claim 2 wherein said surface of said first member is compressed at the interface when the door is in a static state.

4. The check assembly according to claim 3 wherein said surface of said first member retracts to an original state when not at the interface.

5. The check assembly according to claim 1, wherein said surface is disposed on said second member.

6. The check assembly according to claim 1, wherein said first member is spring biased against said second member.

7. The check assembly according to claim 1, wherein said first member is biased against said second member by a magnetic force.

8. The check assembly according to claim 5 wherein said surface of said second member is compressed at the interface when the door is in a static state.

9. The check assembly according to claim 8 wherein said surface of said second member is retracted to an original state when not at the interface.

10. The check assembly according to claim 1, wherein said surface is defined by an open-cell structure which is capable of restoring an original shape after being deformed.

11. The check assembly according to claim 1, wherein said first and second members define a hinge.

12. A vehicle door checkstrap assembly for use with a door of a vehicle for holding the door in an infinite number of stable positions relative to a door frame, comprising;

a strap adapted to be connected to one of the door and the door frame;

a roller supported in rolling engagement with said strap; and an elastically deformable surface disposed on one of said strap and said roller, the surface being elastically deformed at an engagement interface between the strap and the roller to an extent sufficient to hold the strap and roller in a stable stopped position whenever the rolling engagement drops below a predetermined speed.

13. The checkstrap assembly according to claim 12, wherein said elastically deformable surface is disposed on said strap.

14. The checkstrap assembly according to claim 13, wherein said elastically deformable surface of said strap is compressed at the interface when the door is in a static state.

15. The checkstrap assembly according to claim 14, wherein said elastically deformable surface of said strap retracts to an original state when not at the interface.

16. The checkstrap assembly according to claim 12, wherein said elastically deformable surface is disposed on said roller.

17. The checkstrap assembly according to claim 12, wherein said roller is spring biased against said strap.

18. The checkstrap assembly according to claim 12, further comprising a housing for supporting said roller and a spring disposed in said housing for biasing said roller against said strap.

19. The checkstrap assembly according to claim 12, wherein said roller and said strap are magnetically biased.

20. The checkstrap assembly according to claim 16, wherein said elastically deformable surface of said roller is compressed at the interface when the door is in a static state.

21. The checkstrap assembly according to claim 16, wherein said elastically deformable surface of said roller is retracted to an original state when not at the interface.

22. The checkstrap assembly according to claim 12, further comprising a second roller supported in rolling engagement with said strap.

23. A vehicle door checkstrap assembly for use with a door of a vehicle for holding the door in an infinite number of stable positions relative to the door frame, comprising;

a housing including an opening therethrough;

a strap adapted to be connected to one of said door and said frame and extending through said opening in said housing; and a roller supported by said housing in a rolling engagement with said strap;

wherein said strap has an elastically deformable surface disposed thereon, the surface being elastically deformed at an engagement interface between the strap and the roller to an extent sufficient to hold the strap and roller in a stable stopped position whenever the rolling engagement drops below a predetermined speed.

24. A vehicle door checkstrap assembly for use with a door of a vehicle for holding the door in an infinite number of stable positions relative to the door frame, comprising;

a housing including an opening therethrough;

a strap adapted to be connected to one of said door and said frame and extending through said opening in said housing; and a roller supported by said housing in a rolling engagement with said strap;

wherein said roller has an elastically deformable surface disposed thereon, the surface being elastically deformed at an engagement interface between the strap and the roller to an extent sufficient to hold the strap and roller in a stable stopped position whenever the rolling engagement drops below a predetermined speed.

25. A vehicle door check assembly for use with a door of a vehicle for holding the door in an infinite number of stable positions relative to a door a first member adapted to be connected to one of the door and the door frame;

a second member supported in rolling engagement with the first member and biased against the first member by a magnetic force; and a surface disposed on one of the first member and the second member being capable of changing shape.

26. A vehicle door checkstrap assembly for use with a door of a vehicle for holding the door in an infinite number of stable positions relative to a door frame, comprising:

a strap adapted to be connected to one of the door and the door frame;

a roller supported in rolling engagement with the strap, the roller and strap being magnetically biased; and an elastically deformable surface disposed on one of the strap and the roller.

* * * * *